US010126094B2

(12) United States Patent
Kincel et al.

(10) Patent No.: US 10,126,094 B2
(45) Date of Patent: Nov. 13, 2018

(54) FIREARM HANDGUARD ASSEMBLY

(71) Applicant: BRAVO COMPANY MFG. INC., Hartland, WI (US)

(72) Inventors: Eric Stephen Kincel, Las Vegas, NV (US); Jeffrey James O'Brien, Las Vegas, NV (US)

(73) Assignee: BRAVO COMPANY MFG, INC., hartland, WI (US)

( * ) Notice: Subject to any disclaimer, the term of this patent is extended or adjusted under 35 U.S.C. 154(b) by 0 days.

(21) Appl. No.: 15/885,071

(22) Filed: Jan. 31, 2018

(65) Prior Publication Data

US 2018/0172396 A1 Jun. 21, 2018

Related U.S. Application Data

(63) Continuation of application No. 15/701,982, filed on Sep. 12, 2017, which is a continuation of application No. 15/153,464, filed on May 12, 2016, now Pat. No. 9,791,239.

(51) Int. Cl.

| | |
|---|---|
| ***F41C 23/16*** | (2006.01) |
| ***F41A 5/18*** | (2006.01) |
| ***F41A 21/48*** | (2006.01) |

(52) U.S. Cl.

CPC ..... *F41C 23/16* (2013.01); *F41A 5/18* (2013.01); *F41A 21/485* (2013.01)

(58) Field of Classification Search

CPC ..... F41C 23/16; F41A 11/00; F41A 11/02; F41A 3/66; F41A 5/18; F41A 21/482

USPC ..... 42/71.01, 75.01, 75.02, 75.03

See application file for complete search history.

(56) References Cited

U.S. PATENT DOCUMENTS

| | | | |
|---|---|---|---|
| 2,078,010 | A | 4/1937 | Meepos |
| 2,102,964 | A | 12/1937 | Mosseberg |
| 3,066,375 | A | 12/1962 | Knowles et al. |
| 3,177,587 | A | 4/1965 | Hart |
| 3,512,653 | A | 5/1970 | Erismann |
| 3,559,940 | A | 2/1971 | Kruzell |
| 3,798,818 | A | 3/1974 | Casull |
| 3,844,627 | A | 10/1974 | Gutner |
| 3,861,070 | A | 1/1975 | Wild et al. |
| 4,167,884 | A | 9/1979 | Santanna |
| 4,663,875 | A | 5/1987 | Tatro |
| 4,905,396 | A | 3/1990 | Bechtel |
| 4,959,908 | A | 10/1990 | Weyrauch |
| 5,078,215 | A | 1/1992 | Nau |
| 5,590,484 | A | 1/1997 | Mooney et al. |

(Continued)

FOREIGN PATENT DOCUMENTS

| | | |
|---|---|---|
| EP | 1832835 | 9/2007 |
| WO | 2013010515 | 1/2013 |

*Primary Examiner* — Joshua E Freeman

(74) *Attorney, Agent, or Firm* — Michael Best & friedrich LLP

(57) ABSTRACT

A firearm handguard assembly system is disclosed. The system comprises a handguard including at least four apertures, a barrel nut having a first threaded end and a second smooth end, the threaded end coupled to the handguard, and an index block including at least four apertures, the index block coupled to the handguard by at least four screws, each screw having a head and a tip, the tip threaded through: one of the at least four apertures on the index block, and one of the at least four apertures on the handguard.

14 Claims, 14 Drawing Sheets

(56) References Cited

U.S. PATENT DOCUMENTS 5,603,594 A 2/1997 Lincoln
5,632,108 A 5/1997 Ruger et al.
6,609,321 B2 8/2003 Faifer
6,836,990 B2 1/2005 Shiloni
6,874,269 B2 4/2005 Chen et al.
7,216,451 B1 5/2007 Troy
7,325,352 B2 2/2008 Matthews et al.
7,430,829 B2 10/2008 Murello
7,464,495 B2 12/2008 Cahill
D613,811 S 4/2010 Swan
7,712,242 B2 5/2010 Matthews et al.
7,716,865 B2 * 5/2010 Daniel ..... F41C 23/16 42/75.01
7,770,317 B1 8/2010 Tankersley
7,793,452 B1 9/2010 Samson et al.
D636,453 S 4/2011 Fitzpatrick et al.
D641,450 S 7/2011 Ding
7,971,384 B2 7/2011 Lippard
8,006,430 B2 8/2011 Wang
8,051,595 B2 11/2011 Hochstrate et al.
8,141,289 B2 * 3/2012 Gomez ..... F41C 23/16 42/90
8,201,353 B1 6/2012 Swan
8,245,428 B2 8/2012 Griffin
8,312,668 B2 11/2012 Kincel
8,438,770 B2 5/2013 Troy
8,490,316 B2 7/2013 Kincel et al.
8,539,708 B2 * 9/2013 Kenney ..... F41A 21/485 42/75.01
8,578,647 B2 11/2013 Storch et al.
8,607,490 B1 12/2013 Zinsner
D703,286 S 4/2014 Chen et al.
8,739,448 B2 6/2014 Kimmel et al.
8,752,320 B2 6/2014 Masters
D710,964 S 8/2014 Chvala
8,819,980 B2 * 9/2014 Geissele ..... F41C 23/16 42/71.01
D717,907 S 11/2014 Montes
D717,908 S 11/2014 Montes
D720,421 S 12/2014 Chen
8,904,691 B1 12/2014 Kincel
D721,407 S 1/2015 Chu
8,925,236 B1 1/2015 Mayberry et al.
D722,356 S 2/2015 Keller et al.
D725,723 S 3/2015 Eddie
9,103,625 B2 8/2015 Masters
9,157,697 B2 * 10/2015 Leclair ..... F41C 23/16
D744,054 S 11/2015 Peterson et al.
D746,399 S 12/2015 Folkestad, II et al.
D746,936 S 1/2016 Huang
9,239,209 B2 1/2016 Mayberry et al.
9,239,210 B2 1/2016 Mayberry et al.
D749,181 S 2/2016 Hu
9,297,599 B2 3/2016 Underwood et al.
9,303,949 B1 * 4/2016 Oglesby ..... F41A 3/66
D755,338 S 5/2016 Slank
D757,201 S 5/2016 Meier
D757,204 S 5/2016 Chow et al.
D757,878 S 5/2016 Barfoot et al.
9,377,274 B2 6/2016 Kincel
9,383,163 B2 7/2016 Kincel et al.
9,389,043 B1 * 7/2016 Zhang ..... F41C 23/16
9,429,388 B2 8/2016 Mayberry et al.
D768,800 S 10/2016 Willits
9,459,078 B1 10/2016 Kincel
9,464,865 B2 10/2016 Shea et al.
9,470,472 B2 10/2016 Kincel et al.
9,476,672 B2 10/2016 Wells et al.
D771,216 S 11/2016 Dubois
9,523,554 B2 12/2016 Mayberry et al.
D779,013 S 2/2017 Cheng et al.
D779,014 S 2/2017 Cheng et al.
9,581,412 B2 2/2017 Cheng et al.
9,599,439 B1 3/2017 Sylvester
D783,760 S 4/2017 Pavlick
D783,761 S 4/2017 Pavlick
D785,743 S 5/2017 Pavlick
9,696,112 B2 7/2017 Gottzmann et al.
9,709,358 B2 7/2017 Kincel
D795,986 S 8/2017 Frederickson et al.
2001/0045046 A1 11/2001 Otteman
2004/0009034 A1 1/2004 Miller
2005/0268512 A1 12/2005 Battaglia
2006/0191183 A1 8/2006 Griffin
2008/0092422 A1 * 4/2008 Daniel ..... F41C 23/16 42/90
2008/0301994 A1 12/2008 Langevin et al.
2009/0000175 A1 1/2009 Potterfield et al.
2009/0100734 A1 4/2009 Swan et al.
2009/0178325 A1 7/2009 Veilleux
2010/0122485 A1 5/2010 Kincel
2010/0242332 A1 9/2010 Teetzel et al.
2010/0319231 A1 12/2010 Stone et al.
2011/0032694 A1 2/2011 Swan et al.
2011/0126443 A1 6/2011 Sirois
2011/0192066 A1 8/2011 Kimmel et al.
2012/0042557 A1 2/2012 Gomez et al.
2012/0097807 A1 4/2012 Rees
2012/0124880 A1 5/2012 Leclair
2012/0167434 A1 7/2012 Masters
2012/0180359 A1 7/2012 Fitzpatrick et al.
2012/0186123 A1 7/2012 Troy et al.
2012/0311908 A1 * 12/2012 Kenney ..... F41A 21/482 42/75.02
2013/0031820 A1 2/2013 Deros
2013/0036646 A1 2/2013 Rubac et al.
2013/0104441 A1 5/2013 Kincel
2013/0133238 A1 5/2013 Quetschke
2013/0276341 A1 * 10/2013 Wells ..... F41G 11/003 42/71.01
2013/0318848 A1 12/2013 Kincel
2014/0000142 A1 1/2014 Patel
2014/0026459 A1 1/2014 Yan et al.
2014/0041273 A1 * 2/2014 Masters ..... F41C 23/16 42/71.01
2014/0115938 A1 * 5/2014 Jarboe ..... F41A 21/485 42/71.01
2014/0115939 A1 5/2014 Troy et al.
2014/0115940 A1 5/2014 Bonelli et al.
2014/0130390 A1 5/2014 Geissele
2014/0204566 A1 7/2014 Kay
2014/0373419 A1 12/2014 Leclair
2015/0000171 A1 1/2015 Roberts
2015/0198408 A1 7/2015 Kincel et al.
2015/0219422 A1 8/2015 Kincel
2015/0267993 A1 9/2015 Cheng et al.
2015/0285583 A1 10/2015 Mayberry et al.
2015/0285584 A1 10/2015 Mayberry et al.
2015/0285585 A1 10/2015 Hewes et al.
2015/0316347 A1 * 11/2015 Shea ..... F41C 23/16 42/75.02
2015/0369555 A1 12/2015 Daniel et al.
2015/0369558 A1 12/2015 Gottzmann
2016/0010946 A1 * 1/2016 Gibbens ..... F41C 23/16 42/71.01
2016/0025120 A1 1/2016 Swan et al.
2016/0091277 A1 3/2016 Mayberry et al.
2016/0169617 A1 * 6/2016 Daley, Jr. ..... F41C 23/16 42/71.01
2016/0187100 A1 6/2016 Mayberry et al.
2016/0349011 A1 12/2016 Jen
2017/0016695 A1 1/2017 Willits
2017/0067718 A1 3/2017 Mayberry et al.
2017/0205183 A1 7/2017 Ding et al.
2017/0261276 A1 9/2017 Morris
2017/0307328 A1 10/2017 Shelton et al.

* cited by examiner

FIREARM HANDGUARD ASSEMBLY

TECHNICAL FIELD

The present invention generally concerns firearm equipment. More particularly, the present invention relates to a firearm handguard assembly.

BACKGROUND OF THE INVENTION

Traditionally, a handguard is mounted to a firearm using an assembly that uses a basic clamp on the handguard (which may or may not be integrated with the handguard itself) with a slice-bottom design, wherein the bottom portion of the clamp is held together with screws, a two-sided slice design, or a multi-part clamp design. When the screws are tightened, the clamp bears down on the handguard, holding the handguard to the barrel nut. The barrel nut holds the barrel of the firearm in place and is attached to the upper receiver. However, this design is problematic. The tension created by the clamp holds the handguard in place on the barrel nut, but places stress on the upper area of the handguard, which is weaker due to design constraints. This area expands as the clamping mechanism is tightened and more so when the firearm is in use due to the heat generated between the barrel of the firearm, which causes the stress imparted by the clamp to relax as the parts expand due to heat. Traditional designs have placed their hardware in a disadvantaged location due to the lack of clearance available between the various components on top of the barrel nut. There is, therefore, a need for an improved firearm handguard assembly system that obviates the shortcomings of the traditional clamping design.

Similarly, even when a handguard is properly mounted to a firearm, the movement of the handguard may loosen the barrel nut and could result in damage to the firearm. Several solutions have been offered to index the handguard to the upper receiver of the firearm. The most common solution is an anti-slip plate that is affixed to the barrel nut using several screws. This type of assembly can be complicated and time-consuming for the user. Yet another design is a handguard with an indexing tab (or "finger") that extends from the handguard and indexes to the upper receiver of the firearm. Therefore, there is a need for an indexing system that is simple and user-friendly.

The present invention is aimed at one or more of the problems identified above.

BRIEF DESCRIPTION OF THE DRAWINGS

Other advantages of the present invention will be readily appreciated as the same becomes better understood by reference to the following detailed description when considered in connection with the accompanying drawings wherein.

Corresponding reference characters indicate corresponding parts throughout the drawings.

SUMMARY OF THE INVENTION

In one aspect of the present invention, a firearm handguard assembly system is disclosed. The system comprises a handguard, a barrel nut, and an index block. The handguard has at least four apertures. The barrel nut has first threaded end and a second smooth end. The threaded end is coupled to the handguard. The index block includes at least four apertures. The index block is coupled to the handguard by at least four screws. Each screw has a head and a tip. The tip of each screw is threaded through one of the apertures on the index block and one of the apertures on the handguard.

In another aspect of the present invention, a firearm is disclosed. The firearm includes an upper receiver, a handguard including at least four apertures; and a handguard assembly system. The handguard assembly system is used for mounting the handguard to the upper receiver. The handguard assembly system includes a barrel nut having a first threaded end and a second smooth end, the threaded end coupled to the handguard. The handguard assembly system further includes an index block including at least four apertures. The index block is coupled to the handguard by at least four screws, each screw having a head and a tip. The tip of each screw is threaded through one of the apertures on the index block and one of the apertures on the handguard.

DETAILED DESCRIPTION OF THE INVENTION

Embodiments of the present invention provide a handguard assembly and system and method of mounting the assembly to a firearm. Persons of ordinary skill in the art will realize that the following description of the presently invention is illustrative only and not in any way limiting. Other embodiments of the invention will readily suggest themselves to such skilled persons.

Other improved designs have included the use of clamp blocks, cross bolts, and an indexing plate, as described in U.S. Pat. No. 8,904,691, issued to Eric S. Kincel, which is incorporated herein by reference. The design of the present invention uses screws and an index clamp rather than cross bolts and a plurality of clamp blocks.

Figure 1A:
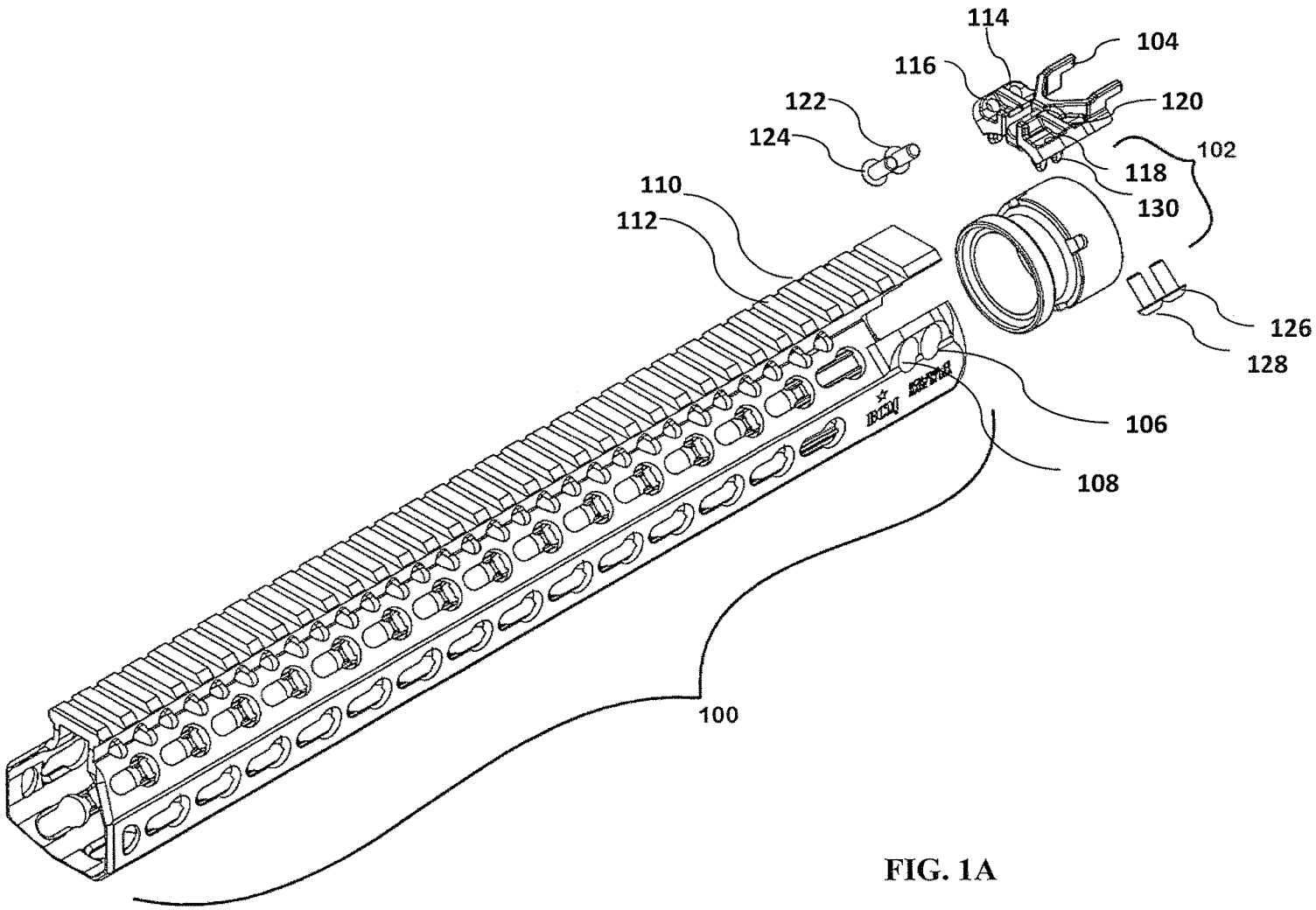
FIG. 1A illustrates an exploded view of an exemplary handguard assembly according to a first embodiment.

Referring now to FIG. 1A, illustrating an exploded view of a firearm handguard assembly system according to a first embodiment, a handguard 100 is coupled to a threaded end of barrel nut 102 to mount the upper receiver of a firearm (FIG. 1I) to handguard 100.

It is contemplated that any handguard may be used in connection with the present invention. In a preferred embodiment, the handguard is made from magnesium rather than aluminum, the typical material for handguards in the industry. Magnesium is lighter than aluminum by a ratio of 1:3, and is therefore an ideal structural material for handguards because it reduces strain on the firearm user during use. However, handguards made from any suitable structural material may be used in connection with the present invention, including without limitation steel (carbon and stainless), aluminum, and titanium.

It is also contemplated that the handguard may contain KeyMod holes, a picatinny rail (also known as a MIL-STD-1913 accessory rail), Magpul® M-LOK® System, GIBBZ Arms™ Modular Attachment (GAMA) System, and/or any other interface system currently available or later developed.

According to the first embodiment, the threaded end of barrel nut 102 is placed inside a first end of handguard 100. Without an index block or plate, the movement of the handguard may loosen the barrel nut and could result in damage to the firearm. Use of index block 104 eliminates rotation of handguard 100 during use.

A first end of handguard 100 contains a first aperture 106 and a second aperture 108 on a first side, and a third aperture 110 and a fourth aperture 112 on a second side. Index block 104 contains an anti-rotational portion and a securing portion. The securing portion contains a first aperture 114 and a second aperture 116 on a first side, and a third aperture 118 and a fourth aperture 120 on a second side. Index block 104 is placed inside the first end of handguard 100 such that first aperture 114 of index block 104 is aligned with first aperture 106 of handguard 100 and second aperture 116 of index block 104 is aligned with second aperture 108 of handguard 100. On the second side of index block 104, third aperture 118 of index block 104 is aligned with third aperture 110 of hand guard 100 and fourth aperture 120 of index block 104 is aligned with fourth aperture 112 of hand guard 100. The anti-rotational portion of the index block 104 includes the rearwardly extending tabs.

A first screw 122 is threaded through first aperture 106 of handguard 100 and first aperture 114 of index block 104. A second screw 124 is threaded through second aperture 108 of handguard 100 and second aperture 116 of index block 104. A third screw 126 is threaded through third aperture 110 of handguard 100 and third aperture 118 of index block 104. A fourth screw 128 is threaded through fourth aperture 112 of handguard 100 and fourth aperture 120 of index block 104.

Index block 104 further includes feet, one of which is labeled 130, which interface with barrel nut 102.

During threading as described above, screws 122, 124, 126, and 128 preclude longitudinal movement of handguard 100, while clamping down on the body of handguard 100 to cause residual force between barrel nut 102 and handguard 100. On an AR-15 platform, the mounting force is spread around the firearm's gas tube (see FIG. 1H). The residual mounting force prevents the handguard from flexing or growing, which ultimately prevents rotation and slippage during use.

Figure 1B:
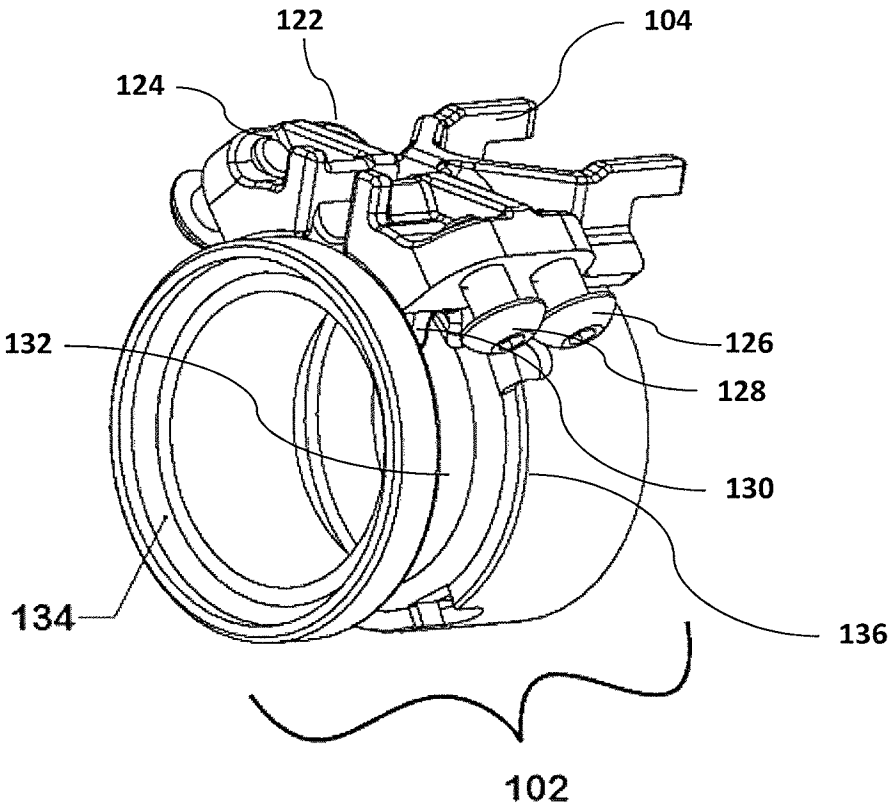
FIG. 1B illustrates a side perspective view of an index block of an exemplary handguard assembly according to a first embodiment.

Referring now to FIG. 1B, a side perspective view of index block 104 and barrel nut 102 of an exemplary handguard assembly according to the first embodiment is shown. Screws 122, 124, 126, and 128 are threaded through index block 104. Feet 130 of index block 104 interface with barrel nut 102 in a groove 132 between a first lip 134 of the threaded end barrel nut 102 and a second lip 136 of the smooth end of barrel nut 102.

Figure 1D:
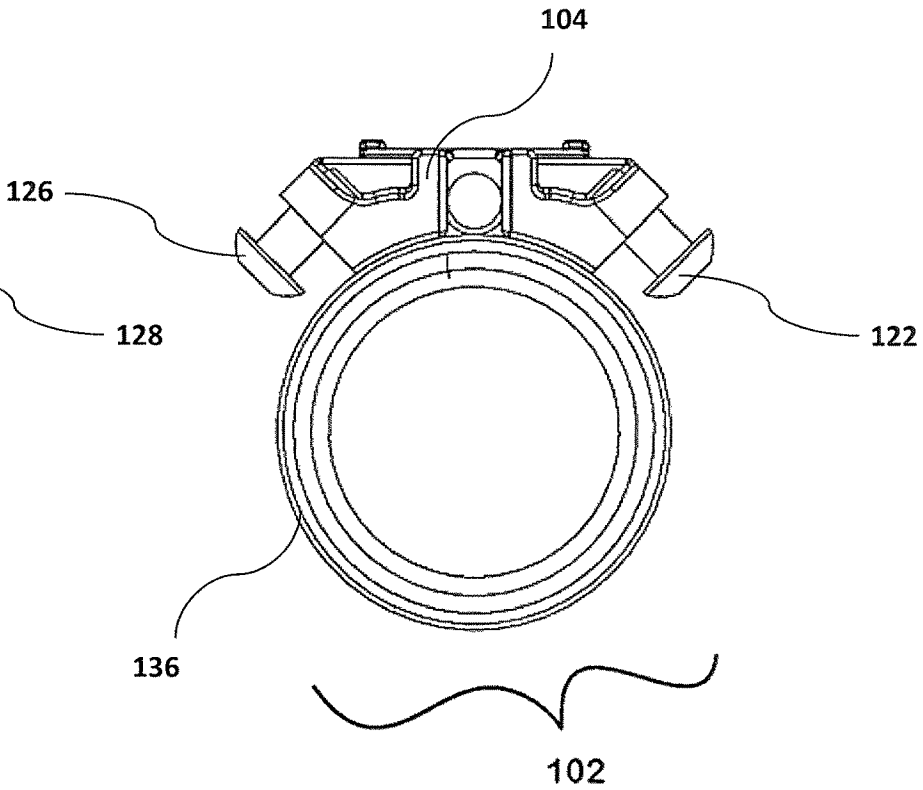
FIG. 1D illustrates a back view of an index block and a barrel nut of an exemplary handguard assembly according to a first embodiment.
Figure 1C:
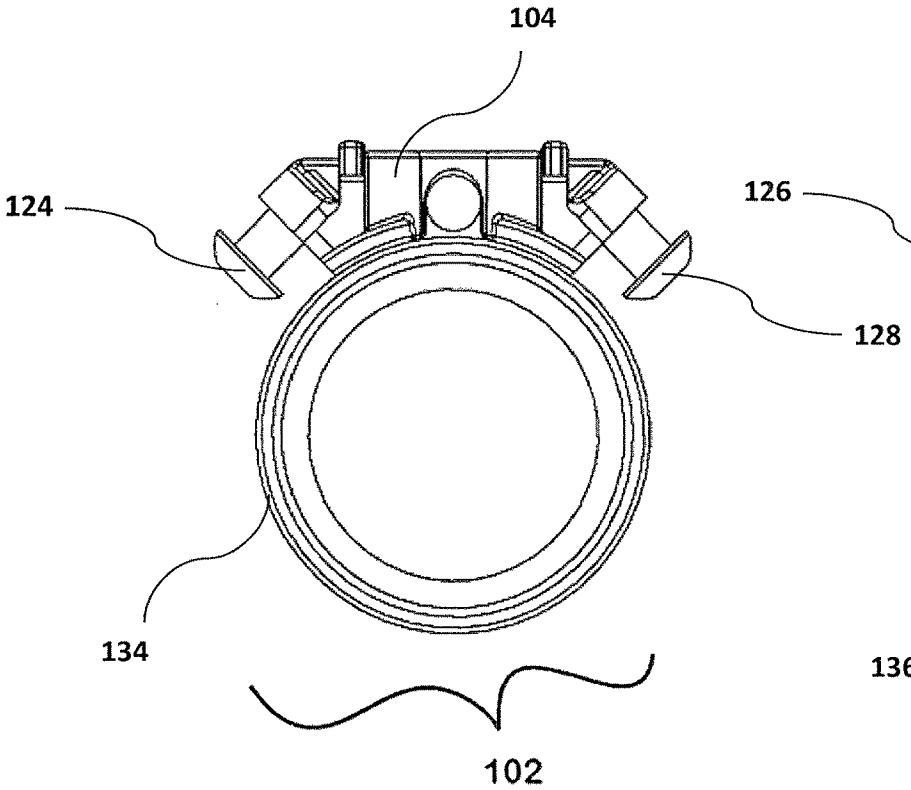
FIG. 1C illustrates a front view of an index block and a barrel nut of an exemplary handguard assembly according to a first embodiment.

Referring now to FIGS. 1C and 1D, a front view and a back view of index block 104 and barrel nut 102 of an exemplary handguard assembly according to the first embodiment are shown, respectively.

Figure 1F:
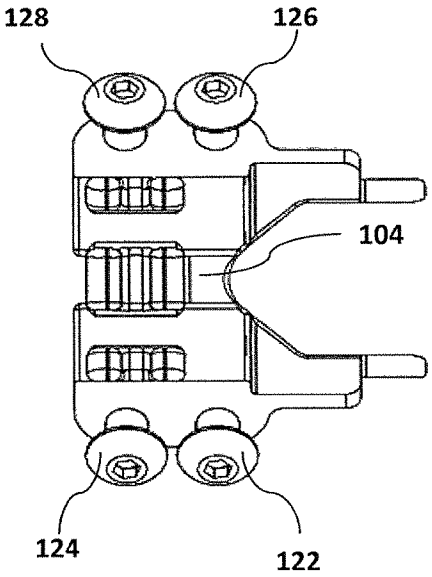
FIG. 1F illustrates a bottom view of an index block of an exemplary handguard assembly according to a first embodiment.
Figure 1E:
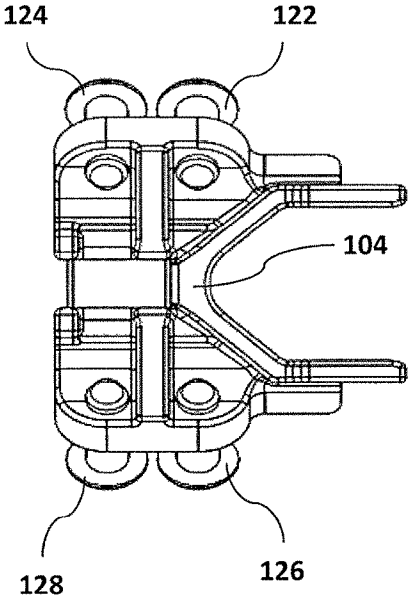
FIG. 1E illustrates a top view of an index block of an exemplary handguard assembly according to a first embodiment.

Referring now to FIGS. 1E and 1F, a top view and a bottom view of index block 104 of an exemplary handguard assembly according to the first embodiment are shown, respectively.

Figure 1G:
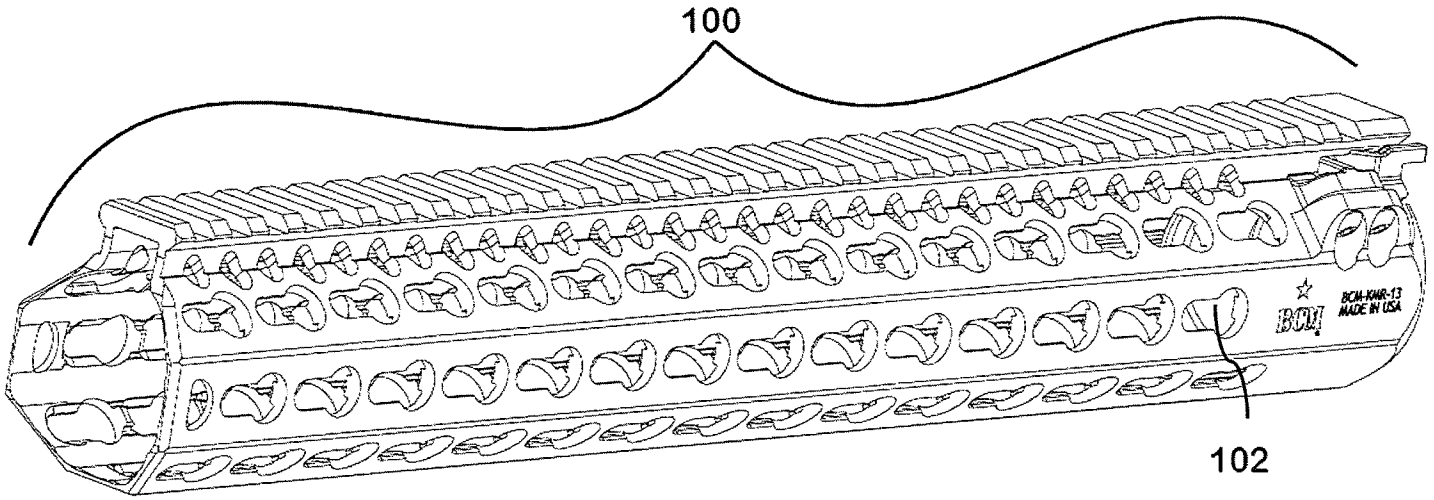
FIG. 1G illustrates a perspective view of a fully assembled exemplary handguard assembly system according to a first embodiment.
Figure 1H:
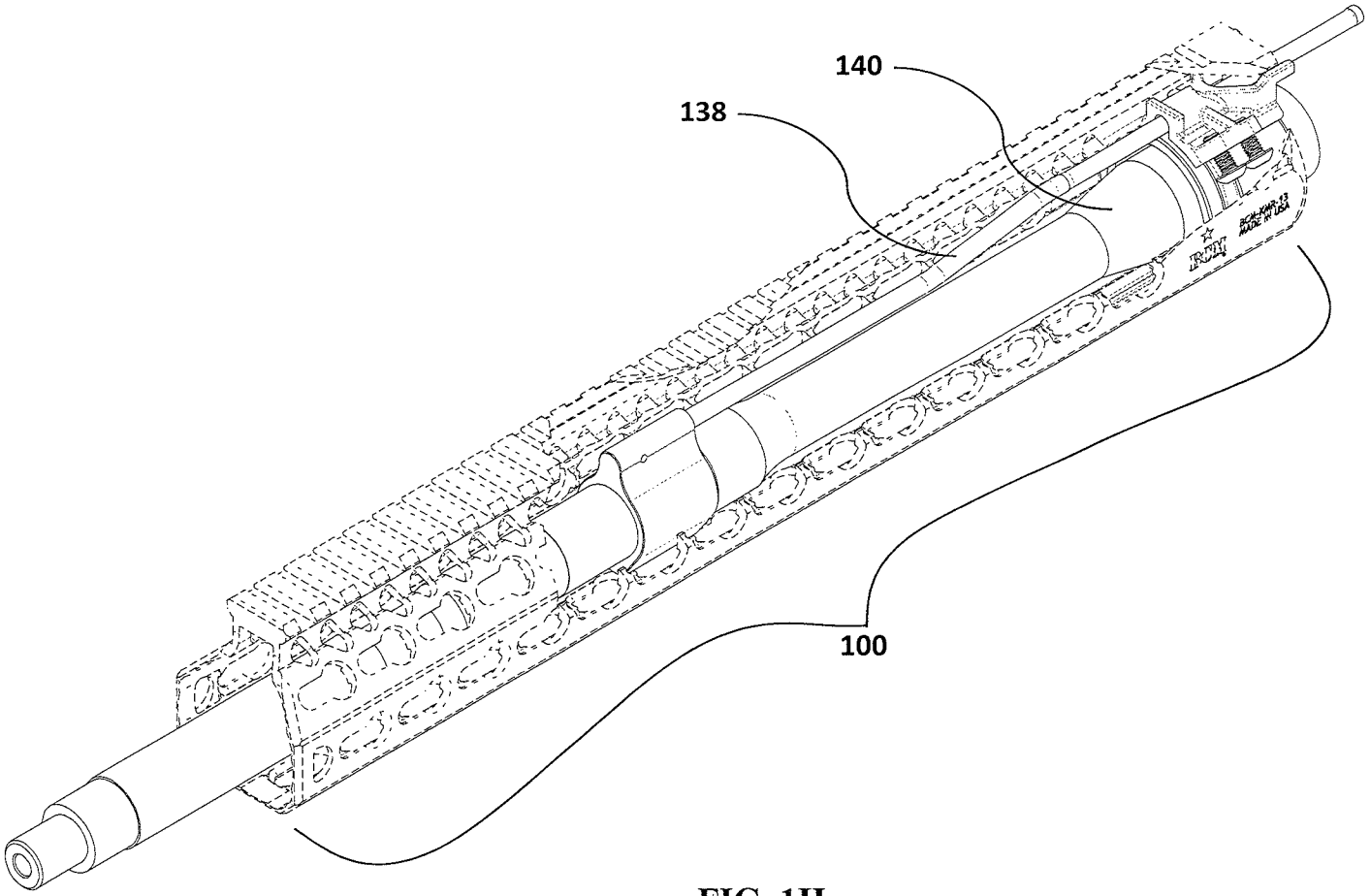
FIG. 1H illustrates a cross-sectional view of a of a fully assembled exemplary handguard assembly system according to a first embodiment.
Figure 1I:
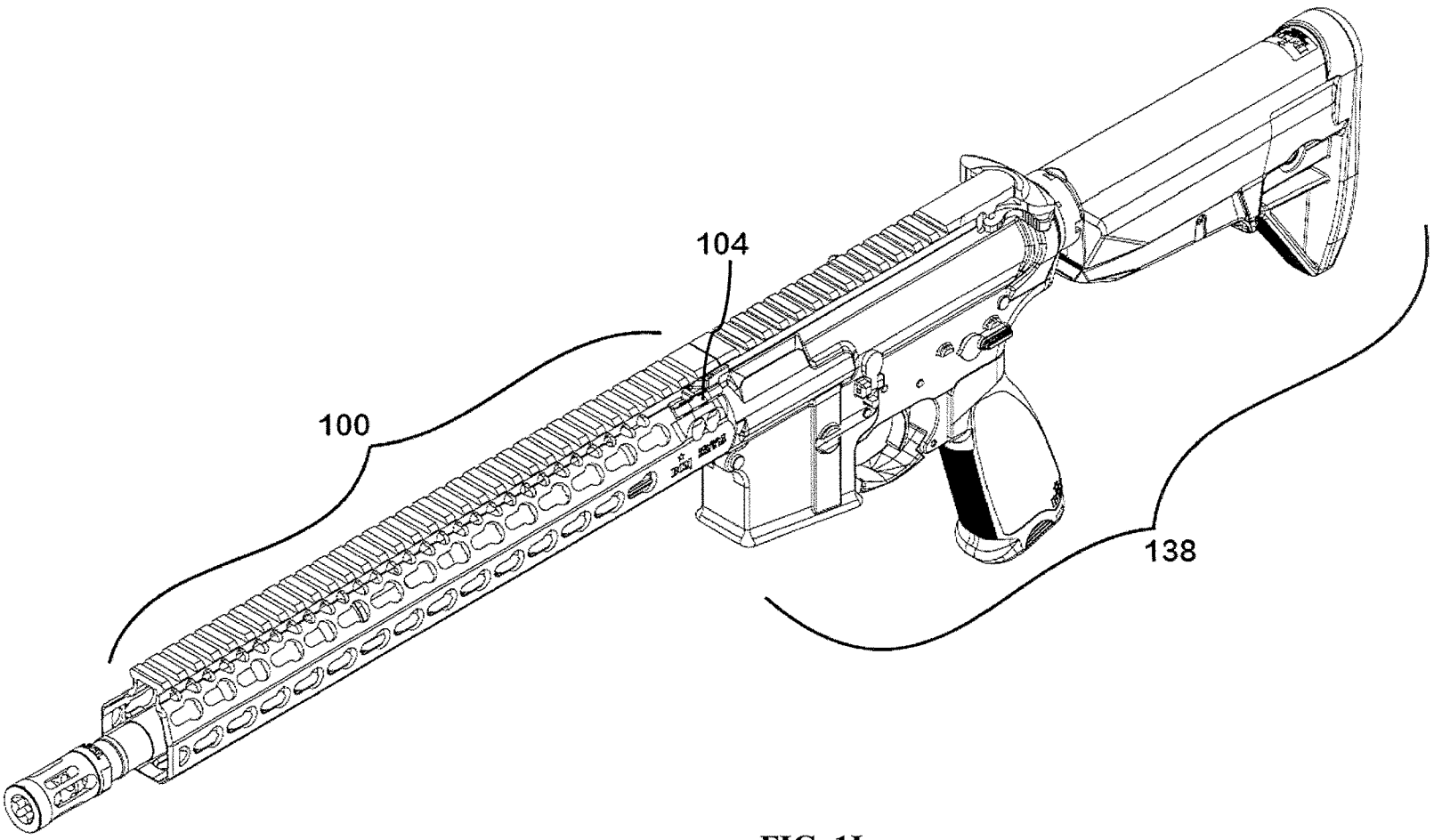
FIG. 1I illustrates a fully assembled firearm handguard assembly system on an exemplary firearm according to a first embodiment.

Referring now to FIG. 1G, illustrating a fully assembled firearm handguard assembly system according to the first embodiment, the barrel nut 102 is secured inside handguard 100 with screws 122, 124, 126, and 128, and the tabs of the indexing block 104 are positioned on opposite sides of the upper receiver accessory rail, allowing handguard 100 to be fully indexed to the upper receiver of the firearm (FIG. 1I). The design of the firearm handguard assembly strengthens the grip of the handguard on the barrel nut, by eliminating non-continuous features within the clamping area of the handguard body, keeping the handguard tensioned in place even under high stress and heat when the firearm is in use.

Referring now to FIG. 1H, illustrating a cross-sectional view of a of a fully assembled exemplary handguard assembly system according to the first embodiment, the handguard 100 includes gas tube 138 and barrel 140.

Referring now to FIG. 1I, illustrating a fully assembled firearm handguard on an exemplary firearm according to the first embodiment, the handguard 100 is secured to exemplary firearm 142 at its upper receiver with index block 104 and screws 122, 124, 126, and 128 in place.

Figure 2A:
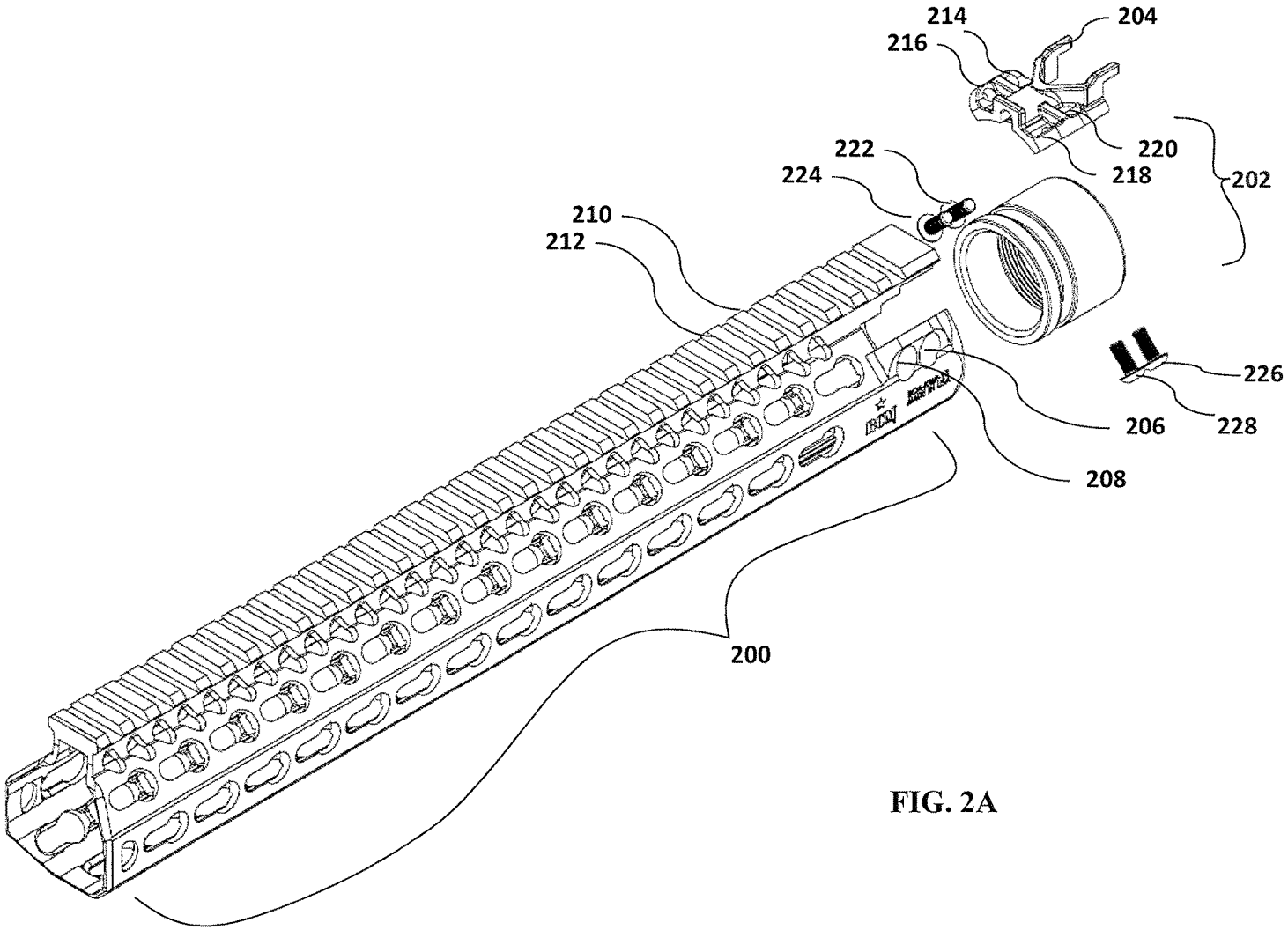
FIG. 2A illustrates an exploded view of an exemplary handguard assembly according to a second embodiment.

Referring now to FIG. 2A, illustrating an exploded view of a firearm handguard assembly system according to a second embodiment, a handguard 200 is coupled to a threaded end of barrel nut 202 to mount the upper receiver of a firearm (FIG. 2I) to handguard 200.

The threaded end of barrel nut 202 is placed inside a first end of handguard 200. Without an index block or plate, the movement of the handguard may loosen the barrel nut and could result in damage to the firearm. Use of index block 204 eliminates rotation of handguard 100 during use.

A first end of handguard 200 contains a first aperture 206 and a second aperture 208 on a first side, and a third aperture 210 and a fourth aperture 212 on a second side. Index block 204 contains an anti-rotational portion and a securing portion. The securing portion contains a first aperture 214 and a second aperture 216 on a first side, and a third aperture 218 and a fourth aperture 220 on a second side. Index block 204 is placed inside the first end of handguard 200 such that first aperture 214 of index block 204 is aligned with first aperture 206 of handguard 200 and second aperture 216 of index block 204 is aligned with second aperture 108 of handguard 200. On the second side of index block 204, third aperture 218 of index block 204 is aligned with third aperture 210 of handguard 200 and fourth aperture 220 of index block 204 is aligned with fourth aperture 212 of handguard 200. The anti-rotational portion of the index block 204 includes the rearwardly extending tabs.

A first screw 222 is threaded through first aperture 206 of handguard 200 and first aperture 214 of index block 204. A second screw 224 is threaded through second aperture 208 of handguard 200 and second aperture 216 of index block 204. A third screw 226 is threaded through third aperture 210 of handguard 200 and third aperture 218 of index block 204. A fourth screw 228 is threaded through fourth aperture 212 of handguard 200 and fourth aperture 220 of index block 204.

During threading as described above, screws 222, 224, 226, and 228 preclude longitudinal movement of handguard 200, while clamping down on the body of handguard 200 to cause residual force between barrel nut 202 and handguard 200. On an AR-10 platform, the mounting force is spread under the gas tube (see FIG. 2H). The residual mounting force prevents the handguard from flexing or growing, which ultimately prevents rotation and slippage during use.

Figure 2B:
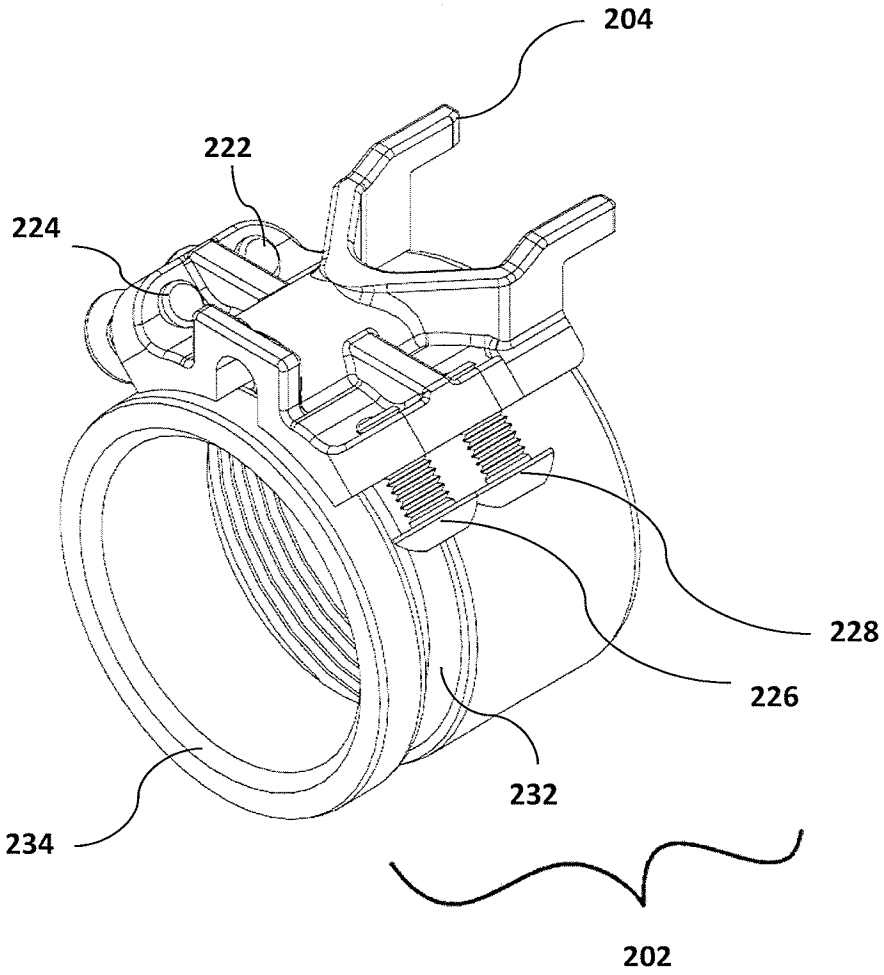
FIG. 2B illustrates a side perspective view of an index block of an exemplary handguard assembly according to a second embodiment.

Referring now to FIG. 2B, a side perspective view of index block 204 and barrel nut 202 of an exemplary handguard assembly according to the second embodiment is shown. Screws 222, 224, 226, and 228 are threaded through index block 204. Index block 204 interfaces with barrel nut 202 in a groove 232 between a first lip 234 of the threaded end barrel nut 202 and a second lip 236 of the smooth end of barrel nut 202.

Figure 2D:
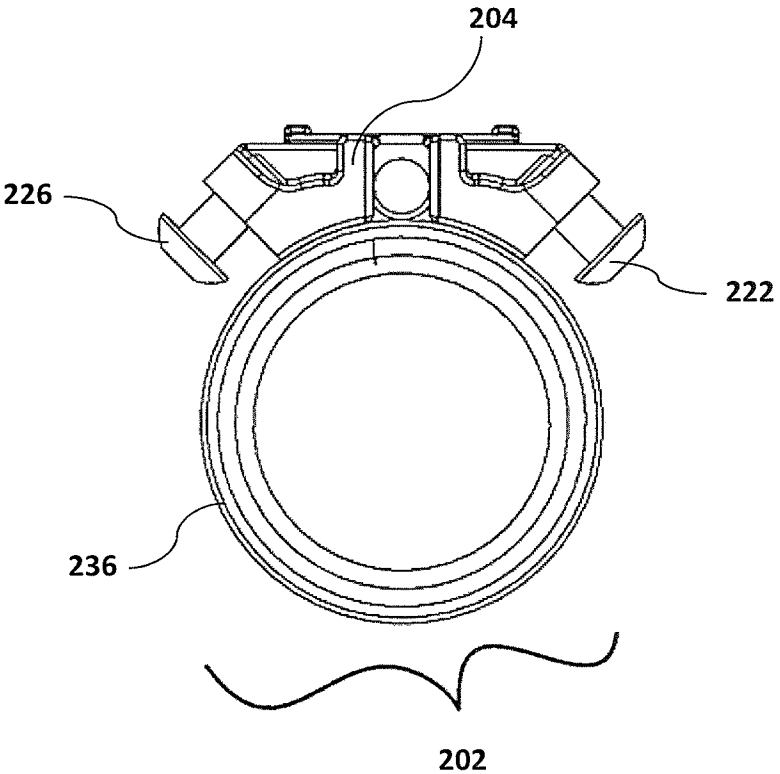
FIG. 2D illustrates a back view of an index block and a barrel nut of an exemplary handguard assembly according to a second embodiment.
Figure 2C:
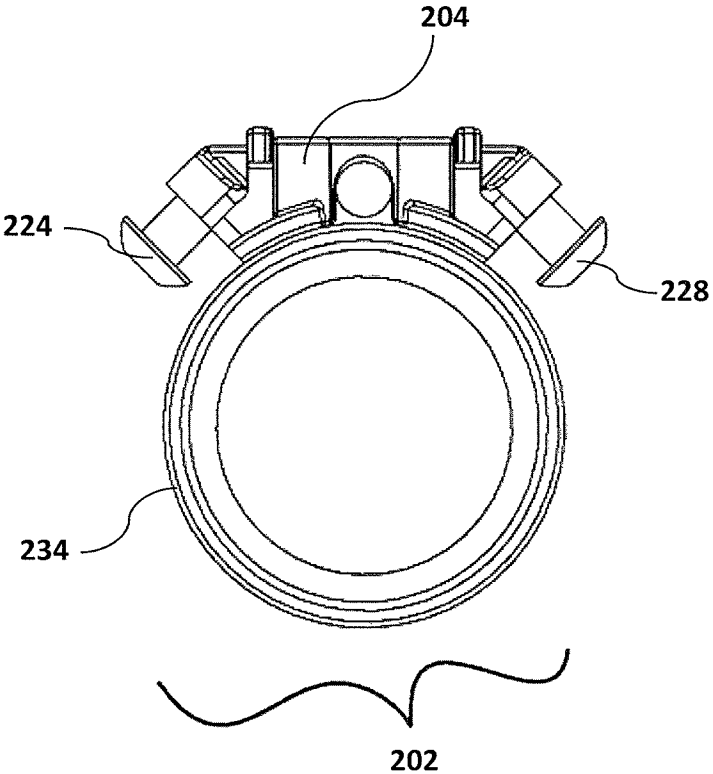
FIG. 2C illustrates a front view of an index block and a barrel nut of an exemplary handguard assembly according to a second embodiment.

Referring now to FIGS. 2C and 2D, a front view and a back view of index block 204 and barrel nut 202 of an exemplary handguard assembly according to the second embodiment are shown, respectively.

Figure 2F:
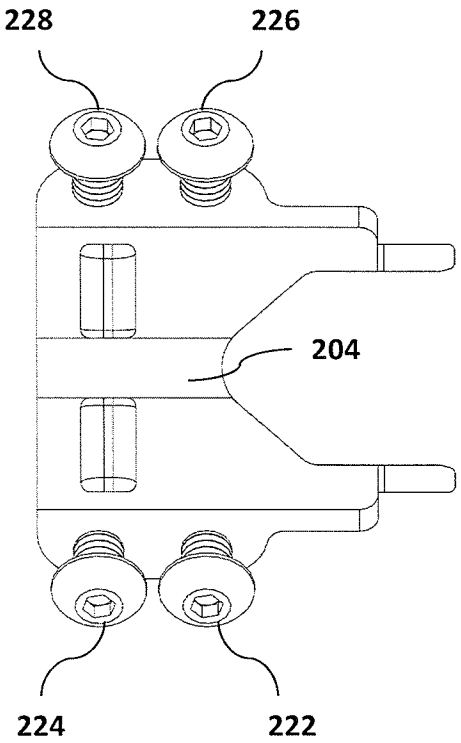
FIG. 2F illustrates a bottom view of an index block of an exemplary handguard assembly according to a second embodiment.
Figure 2E:
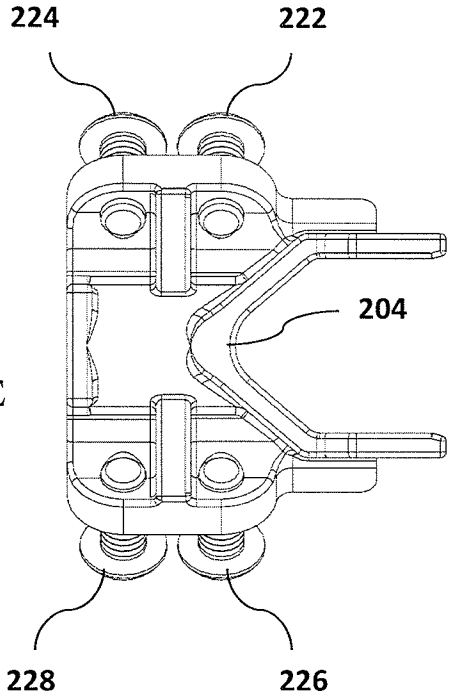
FIG. 2E illustrates a top view of an index block of an exemplary handguard assembly according to a second embodiment.

Referring now to FIGS. 2E and 2F, a top view and a bottom view of index block 204 of an exemplary handguard assembly according to the second embodiment are shown, respectively.

Figure 2G:
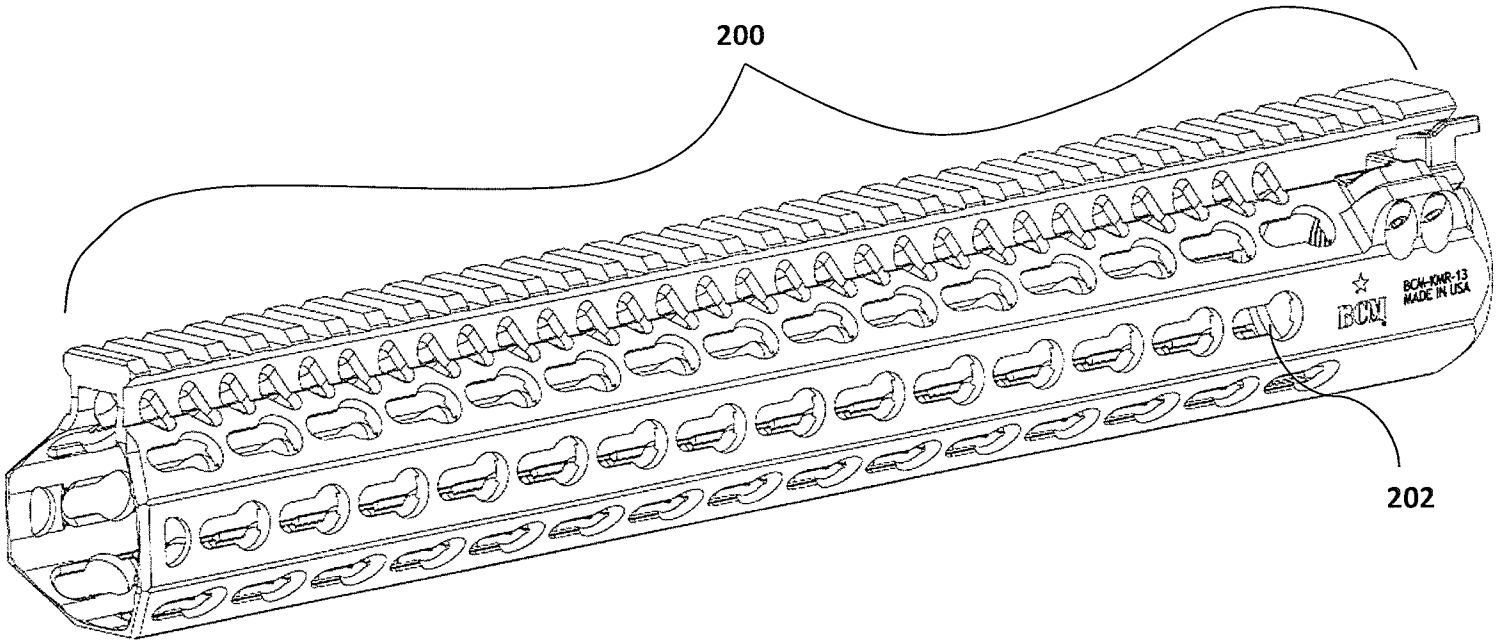
FIG. 2G illustrates a perspective view of a fully assembled exemplary handguard assembly system according to a second embodiment.

Referring now to FIG. 2G, illustrating a fully assembled firearm handguard assembly system according to the second embodiment, the barrel nut 202 is secured inside handguard 200 with screws 222, 224, 226, and 228, and the tabs of the indexing block 204 are positioned on opposite sides of the upper receiver accessory rail, allowing handguard 200 to be fully indexed to the upper receiver of the firearm (see FIG. 21). The design of the firearm handguard assembly strengthens the grip of the handguard on the barrel nut, by eliminating non-continuous features within the clamping area of the handguard body, keeping the handguard tensioned in place even under high stress and heat when the firearm is in use.

Figure 2H:
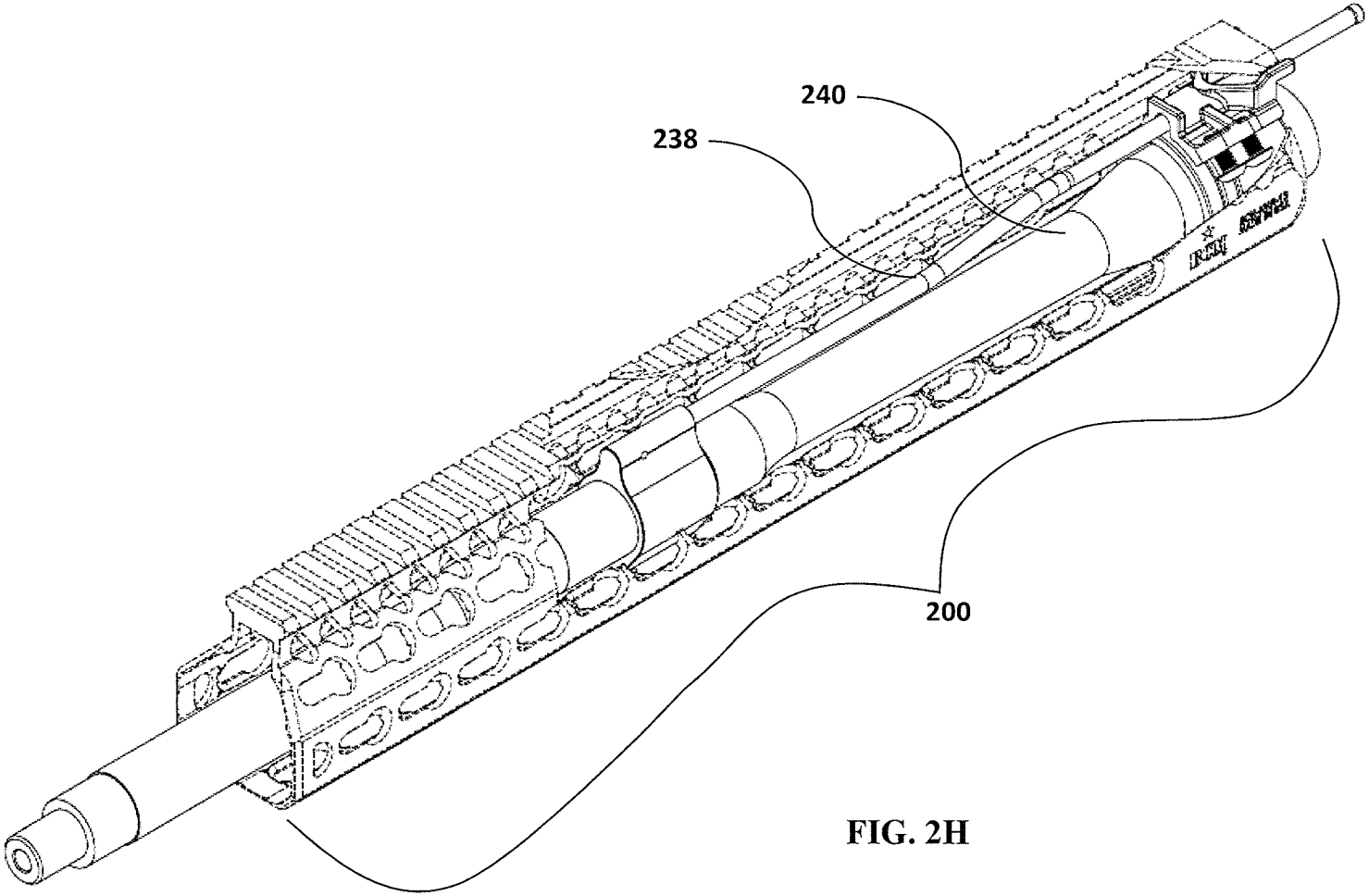
FIG. 2H illustrates a cross-sectional view of a of a fully assembled exemplary handguard assembly system according to a second embodiment.

Referring now to FIG. 2H, illustrating a cross-sectional view of a of a fully assembled exemplary handguard assembly system according to the second embodiment, the handguard 200 includes gas tube 238 and barrel 240.

Figure 2I:
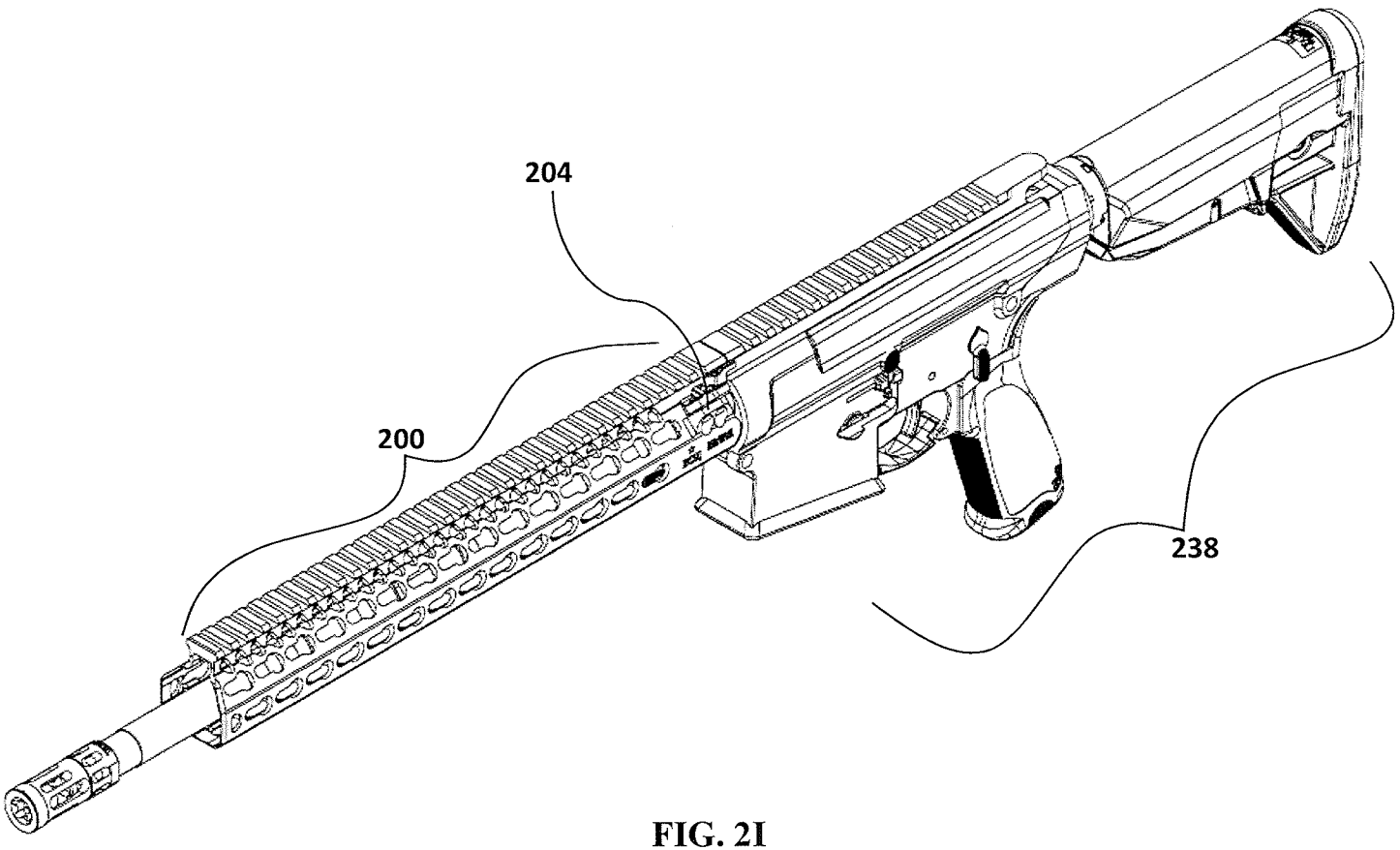
FIG. 2I illustrates a fully assembled firearm handguard assembly system on an exemplary firearm according to a second embodiment.

Referring now to FIG. 2I, illustrating a fully assembled firearm handguard on an exemplary firearm according to the second embodiment, the handguard 200 is secured to exemplary firearm 242 at its upper receiver with index block 204 and screws 222, 224, 226, and 228 in place.

An exemplary firearm may be an AR-10, AR-15, or a variant thereof. The present invention may also be used with any firearm that uses a threaded portion of the forward area of the upper receiver and/or action over which may pass any portion of the operating assembly. By way of example, and not limitation, these firearms may include bolt action rifles for which the user may desire a handguard or fore-end with a top rail and superior clamping force to the receiver. Exemplary embodiments are illustrated herein. The first embodiment, illustrated by FIGS. 1A-1I, shows the present invention on an AR-15 platform. The second embodiment, illustrated by FIGS. 2A-2B, shows the present invention on the AR-10 platform.

Although the exemplary embodiments described herein contain a block and screw assembly that requires one block and four screws, it is contemplated that more or less than four screws may be used. It is also contemplated that the block may be integrated into the handguard body.

The barrel nuts shown in FIGS. 1A-1I and FIGS. 2A-2I use a radial groove long and deep enough to pass a multitude of screws. Alternative embodiments of the barrel nut include, but are not limited to, a barrel nut design containing a plurality of apertures to allow the screws to pass through the apertures and engage the index block; a barrel nut design with a plurality of flat cuts that create clearance for the screws to pass; a barrel nut design with no forward flange but with a protrusion to support the screws; a barrel nut design without any forward flange, no clearance cuts, and which may have screws passing only in front of, or in front of and behind, the barrel nut in order to engage the apertures on either side of the handguard. The barrel nut and related metal mounting hardware made from any suitable structural material may be used in connection with the present invention, including without limitation steel (carbon and stainless) and titanium.

The above description is illustrative and not restrictive. Many variations of the invention will become apparent to those of skill in the art upon review of this disclosure. While the present invention has been described in connection with a variety of embodiments, these descriptions are not intended to limit the scope of the invention to the particular forms set forth herein. To the contrary, the present descriptions are intended to cover alternatives, modifications, and equivalents as may be included within the spirit and scope of the invention as defined by the appended claim and otherwise appreciated by one of ordinary skill in the art.

What is claimed is:

1. A handguard assembly for a firearm including an upper receiver having a receiver rail and a barrel communicating with the upper receiver, the handguard assembly comprising:

a barrel nut adapted for threaded engagement with the upper receiver to secure the barrel to the upper receiver, the barrel nut having an outer surface;

a handguard including a handguard rail and a continuous clamping area, the continuous clamping area positioned around the outer surface of the barrel nut and the handguard rail extending away from the barrel nut; and a single-piece indexing block comprising an anti-rotational portion adapted to engage the receiver rail and a securing portion for connecting to the handguard, the anti-rotational portion and securing portion being integrally formed in the single-piece indexing block;

wherein connecting the handguard to the securing portion of the indexing block causes the continuous clamping area of the handguard to radially tighten on the outer surface of the barrel nut.

2. The handguard assembly of claim 1, wherein the barrel nut includes a groove in the outer surface and the indexing block includes a foot extending into the groove to resist axial movement of the indexing block and handguard with respect to the barrel nut.

3. The handguard assembly of claim 1, wherein the handguard includes a slot between the handguard rail and the continuous clamping area, the indexing block being positioned in the slot.

4. The handguard assembly of claim 1, further comprising at least one fastener extending through aligned apertures in the indexing block and the handguard, the at least one fastener being actuable to tighten the continuous clamping area of the handguard with respect to the barrel nut.

5. The handguard assembly of claim 1, further comprising a mechanism for drawing top portions of the continuous clamping area of the handguard toward each other between the handguard rail and the barrel nut.

6. The handguard assembly of claim 1, wherein the upper receiver includes a gas tube communicating between the barrel and the upper receiver, and the indexing block extends at least partially around the gas tube.

7. The handguard assembly of claim 1, wherein the upper receiver includes a gas tube communicating between the barrel and the upper receiver, and the indexing block includes a portion between the gas tube and the barrel nut.

8. A firearm comprising:

an upper receiver having a receiver rail;

a barrel communicating with the upper receiver;

a barrel nut adapted for threaded engagement with the upper receiver to secure the barrel to the upper receiver, the barrel nut having an outer surface;

a handguard including a handguard rail and a continuous clamping area, the continuous clamping area positioned around the outer surface of the barrel nut and the handguard rail extending away from the barrel nut; and a single-piece indexing block comprising an anti-rotational portion engaging the receiver rail and a securing portion for connecting to the handguard, the anti-rotational portion and securing portion being integrally formed in the single-piece indexing block;

wherein connecting the handguard to the securing portion of the indexing block causes the continuous clamping area of the handguard to radially tighten on the outer surface of the barrel nut.

9. The firearm of claim 8, wherein the barrel nut includes a groove in the outer surface and the indexing block includes a foot extending into the groove to resist axial movement of the indexing block and handguard with respect to the barrel nut.

10. The firearm of claim 8, wherein the handguard includes a slot between the handguard rail and the continuous clamping area, the indexing block being positioned in the slot.

11. The firearm of claim 8, further comprising at least one fastener extending through aligned apertures in the indexing block and the handguard, the at least one fastener being actuable to tighten the continuous clamping area of the handguard with respect to the barrel nut.

12. The firearm of claim 8, further comprising a mechanism for drawing portions of the continuous clamping area of the handguard toward each other between the handguard rail and the barrel nut.

13. The firearm of claim 8, wherein the upper receiver includes a gas tube communicating between the barrel and the upper receiver, and the indexing block extends at least partially around the gas tube.

14. The firearm of claim 8, wherein the upper receiver includes a gas tube communicating between the barrel and the upper receiver, and the indexing block includes a portion between the gas tube and the barrel nut.

* * * * *